United States Patent [19]

Nelson

[11] Patent Number: 4,732,436

[45] **Date of Patent: * Mar. 22, 1988**

[54] CANTILEVERED DRAWER SLIDE ARRANGEMENT

[76] Inventor: Gary W. Nelson, 22933 Hatteras St., Woodland Hills, Calif. 91367

[ * ] Notice: The portion of the term of this patent subsequent to Oct. 7, 2003 has been disclaimed.

[21] Appl. No.: 882,826

[22] Filed: Jul. 7, 1986

Related U.S. Application Data

[63] Continuation of Ser. No. 533,996, Sep. 20, 1983, Pat. No. 4,615,572.

[51] Int. Cl.[4] ..... A47B 88/04

[52] U.S. Cl. ..... 312/341 R; 312/330 R; 312/339; 312/344; 312/348; 384/19

[58] Field of Search ..... 312/343, 344, 333, 346, 312/347, 330 R, 330 SM, 338, 339, 340, 341 R, 348, 350, 341 NR; 211/94; 384/18, 19

[56] References Cited

U.S. PATENT DOCUMENTS

| | | | |
|---|---|---|---|
| Re. 29,222 | 5/1972 | Hosmer | 312/343 X |
| 167,161 | 8/1875 | Freese | 312/341 R |
| 466,069 | 12/1891 | Baldwin, Jr. | 312/341 R |
| 524,225 | 8/1894 | Smith | 312/338 |
| 686,777 | 11/1901 | Snook | 312/339 |
| 1,039,548 | 9/1912 | Kral | 312/348 X |
| 1,537,067 | 5/1925 | Card | 384/19 |
| 1,705,571 | 3/1929 | Jones | 312/339 |
| 1,993,477 | 3/1935 | Gourley et al. | 312/333 X |
| 2,300,287 | 10/1942 | Huarisa | 312/343 |
| 2,534,350 | 12/1950 | Gussack | 312/340 X |
| 2,582,471 | 1/1952 | West | 312/343 |
| 2,751,272 | 6/1956 | Hutzelman | 312/341 R |
| 2,843,444 | 7/1958 | Nelson | 312/341 R |
| 2,859,070 | 11/1958 | Gommersall | 312/339 X |
| 2,941,847 | 6/1960 | Dargene | 384/19 |
| 3,099,501 | 7/1963 | Hillson et al. | 384/19 |
| 3,185,530 | 5/1965 | Reiss, Sr. et al. | 312/341 NR |
| 3,186,772 | 6/1965 | Cohn | 385/18 |
| 3,328,106 | 6/1967 | Mullin | 312/341 R |
| 3,384,431 | 5/1968 | Dargene | 312/343 |
| 3,664,716 | 5/1972 | Johnson | 312/348 X |
| 3,744,869 | 7/1973 | Anderson et al. | 312/330 R |
| 3,836,223 | 9/1974 | Sigmore | 312/341 R X |
| 4,125,297 | 11/1978 | Merters | 312/348 X |
| 4,196,943 | 4/1980 | Rock et al. | 312/348 X |
| 4,199,200 | 4/1980 | Livingston | 384/19 |
| 4,294,499 | 10/1981 | Rock et al. | 312/348 X |
| 4,333,690 | 6/1982 | Keefe et al. | 384/19 |
| 4,615,572 | 10/1986 | Nelson | 312/330 R X |

FOREIGN PATENT DOCUMENTS

| | | | |
|---|---|---|---|
| 159098 | 7/1940 | Austria | 312/330 R |
| 2319568 | 11/1974 | Fed. Rep. of Germany | 312/330 R |
| 2622514 | 12/1977 | Fed. Rep. of Germany | 312/330 R |
| 2946113 | 5/1981 | Fed. Rep. of Germany | 312/340 |
| 3135222 | 3/1983 | Fed. Rep. of Germany | 312/330 R |
| 410069 | 12/1909 | France | 312/339 |
| 387655 | 5/1931 | United Kingdom | 312/343 |
| 1135683 | 12/1968 | United Kingdom | 312/330 R |
| 2093334 | 9/1982 | United Kingdom | 312/343 |

*Primary Examiner*—Peter A. Aschenbrenner
*Assistant Examiner*—Thomas A. Rendos
*Attorney, Agent, or Firm*—William W. Haefliger

[57] ABSTRACT

A cantilevered drawer slide arrangement for supporting drawers where the slide hardware is entirely hidden inside the drawer cabinet. A pair of individual tracks are mounted on each side of the cabinet inside the front face. A square bracket having roller wheels fits on each side of the rear of the drawer. The forward wheel is behind the rear third of the drawer. The wheels ride in the tracks on each side and are kept in the cabinet by track stops. An adjustable drawer alignment screw on each side of the drawer between the drawer and the drawer cabinet provides a means to minimize the drawer side movement when the drawer is extended.

5 Claims, 42 Drawing Figures

CANTILEVERED DRAWER SLIDE ARRANGEMENT

This is a continuation of application Ser. No. 533,996, field Sept. 2, 1983, U.S. Pat. No. 4,615,572.

BACKGROUND OF THE INVENTION

1. Field of the Invention

This invention relates to the cabinenry art, and more particularly, to a cantilevered drawer slide arrangement where the slide hardware may remain hidden behind the front face of the drawer cabinet.

2. Description of the Prior Art

Numerous devices have been utilized throughout history to guide drawers in and out of drawer cabinets. The simplest mechanism is a box in which the drawer slides. Other methods of control include runners on either side of the drawer or a single runner under the bottom of the drawer with notches to hold the drawer in alignment with the cabinet. All of these basic guide systems have high levels of friction between the drawer and the cabinet and, consequently, rapidly wear out. Numerous low friction devices have been designed to facilitate movement of drawers in and out of cabinets including ball bearings, wheels, and sliders. Most of these low friction devices require unsightly tracks along the side of the drawers and wide spaces between the sides of the drawers and the drawer face to allow passage of the low friction devices from the inside of the drawer cabinet to the outside when the drawer is extended.

Side play of the drawer when extended is another difficult problem particularly in the basic forms of drawer guides. Often the drawer must be moved from side to side and up and down in order to get it to return to the drawer cabinet. As the guides become worn, the problem becomes even more severe. Even drawer slides utilizing rollers, ball bearings and sliders have blinding problems especially when the drawers are heavily loaded or the slide parts have become slightly worn.

The ball bearing type of drawer slide creates a different problem in that the drawer cabinet must be perfectly aligned with the drawer slide in order to eliminate binding as the drawer is moved in and out because there is virtually no side play in a ball bearing slide. Skilled labor and time are required to properly position a ball bearing slide.

Another fitting problem exists in all low friction slide arrangements which must be fabricated specifically for the various lengths of drawers. A long drawer requires a long slide arrangement and a short drawer requires a short slide. Manufacturers of cabinetry must have many different lengths of drawer slides in order to make the various lengths of drawers, or cut the slides to fit.

SUMMARY OF THE INVENTION

Accordingly, it is the primary object of the present invention to provide an improved drawer slide arrangement.

It is another object of the present invention to provide a cantilevered drawer slide arrangement.

It is a further object of the invention to provide a cantilevered drawer slide arrangement having low friction supports.

It is another object of the present invention to provide a drawer slide arrangement where the slide hardware remains hidden behind the face of the drawer cabinet.

It is a further object of the invention to provide a drawer slide arrangement where the drawer brackets are rapidly and accurately attached to the rear of the drawer.

It is another object of the present invention to provide a drawer slide arrangement where precise alignment between the cabinet tracks and the drawer slides is not required.

It is another object of the present invention to provide a drawer slide requiring a minimum of distance between the side of the drawer and the face of the drawer cabinet.

It is another object of the present invention to provide a drawer slide arrangement maximizing the aesthetic appearance of the extended drawer and cabinet.

It is yet another object of the present invention to provide a means for controlling side wobble of the drawer when it is extended from the cabinet.

It is yet another object of the present invention to provide a side wobble control means which is easily adjustable.

It is another object of the present invention to provide a slip connector for roller bearing drawer slides which does not require precise alignment between the drawer and the drawer cabinet.

It is another object of the present invention to provide drawer slide arrangements which may be utilized on any length of drawer without requiring different lengths of drawer brackets.

The above, and other objects of the present invention, are achieved according to the preferred embodiment thereof by providing a pair of individual tracks for receiving rotatable antifriction members mounted on either side of the drawer in the drawer cabinet. Brackets having right angle fitting members are attached to either side of the rear of the drawer behind the rear third of the drawer. The brackets have roller wheels which engage the tracks in the drawer cabinet. Roller stops in the front of the tracks keep the drawer from coming out of the cabinet unless removal of the drawer is actually desired.

Placement of all of the slide hardware behind the rear third of the drawer allows most of the useful area inside the drawer to be exposed while at the same time eliminating any unsightly tracks on the sides of the drawer when the drawer is extended. The drawer is cantilevered on the slide hardware. The relationship between the drawer and the tracks always remains the same no matter whether the drawer is fully extended or pushed inside the cabinet. No part of the drawer ever touches the cabinet other than the roller wheels on the drawer brackets. Friction between the drawer and the drawer face bottom is impossible.

Side wobble when the drawer is extended is minimized by the utilization of adjustable drawer alignment means mounted on each side of the drawer between the drawer and the drawer case. The drawer aligners are injection molded low coefficient of friction plastic wedges with screws inside for forcing apart the sides of the drawer aligners allowing adjustment of the aligners to precisely match the space between the sides of the drawer and the drawer cabinet.

One embodiment of the present invention utilizes the space between the back of the closed drawer and the back of the cabinet when such a space exists by locating a roller wheel on the bracket attached to the drawer behind the rear of the drawer. In this manner, the distance between the rearmost roller wheel and the front roller wheel is maximized.

Ball bearings may also be utilized to minimize the friction between the drawer and the drawer cabinet. Again, the portion of the slide located on the drawer remains behind the rear third of the drawer and may extend behind the back of the drawer if space is available between the closed drawer and the back of the cabinet. The problem of precisely aligning the sides of the drawer, the drawer slides, and the drawer cabinet is minimized by the utilization of a horizontal slip coupler between the slide hardware on the drawer and the slide itself.

Another embodiment of the present invention utilizes low friction plastic slides or glide blocks in place of roller wheels or roller bearings. Each glide block has a slot in the middle allowing the tracks on the cabinet to be formed with a single rail perpendicular to the side of the cabinet. Other embodiments also use the single perpendicular rail including one with a roller wheel mounted on the bracket in a location where the roller wheel rides on top of the track at the front of the drawer and a second roller wheel rides below the track at the rear of the drawer. A similar drawer bracket can be fabricated utilizing a plastic glide block for the front low friction support.

In order to keep the drawer from falling out of the cabinet when it is extended, track stops are used at the front of the tracks. The basic form of track stop is a detent at the front of the track which stops the forward roller wheel from moving further forward unless actual removal of the drawer is desired and additional force is used to pull the drawer from the cabinet. Alternate forms of stops include tabs on both the drawer brackets and tracks which physically abut each other when the drawer is fully extended. Removal of the drawer when desired requires movement of the stops out of alignment with varying degrees of difficulty depending upon the nature of the stop tabs. In the most basic form, the tabs are simply metal parts extending out from the brackets and tracks. Lifting of the drawer to avoid interference of the parts allows removal of the drawer. Alternately, the tab on the track may remain fixed and a lever placed on the drawer bracket having a tab which may be moved up away from the track tab to allow removal of the drawer as desired.

Other improvements in the present invention include a stapling strip which is placed over the screw apertures in the brackets. Staples are shot through the holes in the brackets securely attaching the drawer to the brackets in a fraction of the time that would be required if screws were utilized.

Another embodiment of the present invention provides a means for adjusting the vertical location of the roller wheels in relation to the drawer brackets. One or more of the roller wheels on each of the brackets is mounted on an axle located on a lever having a lever axle attached to the drawer bracket. A screw means between the bracket and the lever near the roller wheel axle allows the roller wheel to be adjusted up and down in relation to the drawer bracket. Precise vertical alignment may thereby be achieved between the top and bottom of the drawer face and the top and bottom of the cabinet face.

Another embodiment of the present invention has a similar roller wheel and lever combination. In this embodiment the roller wheel is biased toward the bottom of the drawer by a spring. When this spring embodiment is placed at the front of the drawer bracket, protection of the drawer slide is provided against heavy loads in the drawer which would otherwise damage the drawer slide. If the weight in the front of the drawer exceeds the specifications of the spring, the bottom of the drawer rests on the bottom front piece.

A final embodiment of the present invention provides a method for removing the drawer from the slide. In this embodiment, no moving portions of the drawer slide arrangement are removed from the cabinet. The drawer has a pin on each bracket at the bottom and back of the drawer. The pins fits into apertures on the back of the drawer slides providing vertical retention of the drawer in the drawer slide. A tab near the front of each bracket on the drawer fits into a slot near the front of the slide arrangement. Removal of the drawer is achieved by pulling the drawer out of the cabinet to the full extent possible and then lifting the front of the drawer up out of the slots so that the pins may be pulled out of the apertures in the backs of the slides. A spring on each slide at the bottom retains the slide in a fixed position when the drawer is removed. When the drawer is reinserted by placing the pins in the slides and returning the tabs to the slots, the weight of the drawer pushes down on the springs which in turn forces the springs out of engagement with the cabinet tracks placing the drawer slides again in an operative position.

The cantilevering support means which are secured to the drawer are preferably relatively short such as ten or twelve inches in length or less, so that they may be used with virtually any drawer. Accordingly even with short drawers such as those often used in campers and boats, for example, the standard supports may still be employed.

BRIEF DESCRIPTION OF THE DRAWING

The above and other embodiments of the present invention may be more fully understood from the following detailed description taken together with the accompanying drawings wherein similar reference characters refer to similar elements throughout and in which.

DESCRIPTION OF THE PREFERRED EMBODIMENT

Figure 1:
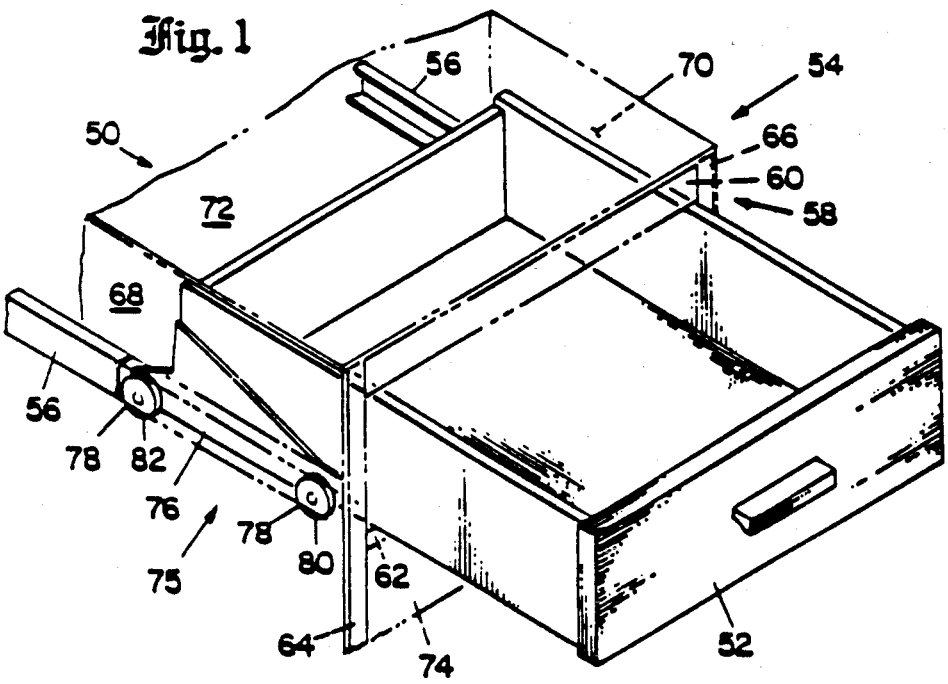
FIG. 1 is a perspective view of a cantilevered drawer slide carrying a drawer mounted in a cabinet.

Referring now to the various figures of the drawing, there is illustrated in FIG. 1 a perspective view of a cantilevered drawer slide arrangement, generally designated 50, and installed between drawer 52 and cabinet 54. Tracks 56 are mounted on cabinet 54 on either side of drawer 52. Cabinet 54 has a frame 58 including top front piece 60, bottom front piece 62, left side piece 64, and right side piece 66. Attached to frame 58 are left side 68, right side 70, and top 72. A second drawer 74 is mounted on the rear below drawer 52. Support means 75 is mounted on the rear third of drawer 52 and includes bracket means 76 and rotatable antifriction members 78 such as front roller wheel 80 and rear roller wheel 82 which engage track 56. A similar bracket which is not illustrated is located on the right rear corner of drawer 52. Support means 75 retains drawer 52 in the same cantilevered relationship to track 56 at all times whether drawer 52 is empty or loaded or is pulled out of cabinet 54 as illustrated or pushed into cabinet 54. Drawer 52 never touches bottom front piece 62 or any other portion of cabinet 54.

Track 56 ends inside of left side piece 64. Front wheel 80 never appears outside of cabinet 54. Drawer 52 is fully extended as shown. Drawer slide arrangement 50 thereby allows a minimal space between drawer 52 and frame 58 on either side of drawer 52. Further, no unsightly drawer hardware appears on the side of drawer 52 when drawer 52 is pulled out of cabinet 54.

Figure 2:
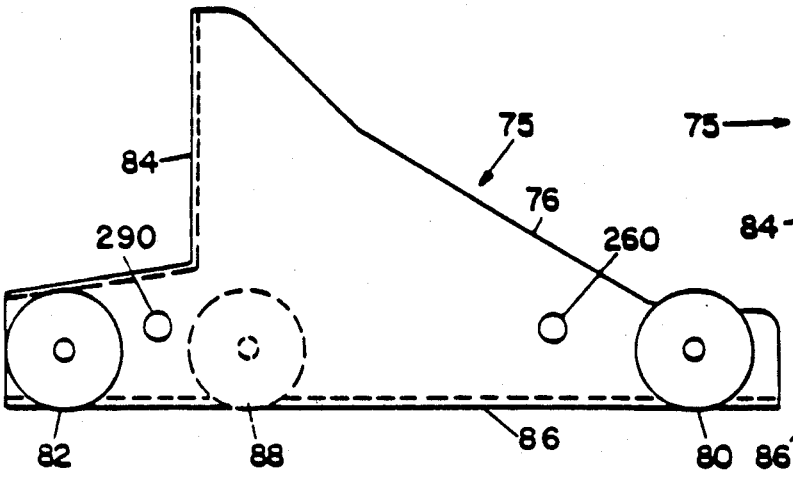
FIG. 2 is a side view of the support means shown in FIG. 1.

FIG. 2 is a side view of support means 75 shown in FIG. 1. The back of drawer 52 illustrated in FIG. 1 fits against vertical flange 84 and the bottom rests on horizontal flange 86. Bracket 76 is thereby rapidly and accurately fitted to the square rear corner of drawer 52. As shown in FIG. 2, rear wheel 82 is mounted on a portion of bracket 76 which is behind the rear of drawer 52. A roller wheel 88 such as illustrated by the dotted line may be attached in front of the rear of drawer 52 if desired and bracket 76 cut off along the line of vertical flange 84. The reason for placing rear wheel 82 on a portion of bracket 76 behind vertical flange 84 is to increase the distance between front wheel 80 and rear wheel 82. Increasing the distance decreases the force caused by the weight of drawer 52 in front of front wheel 80 on the rear wheel, whether the rear wheel is rear wheel 82 or alternate rear wheel 88. Also, placing the rear wheel at the location shown by rear wheel 82 instead of the location shown by alternate rear wheel 88 enhances the stability and durability of drawer slide arrangement 50. Placement of rear wheel 82 behind the rear of drawer 52 is possible because most cabinets are constructed deeper than the drawers put into them. A typical kitchen cabinet is 24" deep and has drawers that are 20" to 22" deep. Two to four inches are, therefore, usually available behind the rear of a drawer before the back of the cabinet is reached.

One advantage of the present invention is illustrated by FIGS. 1 and 2. Track 56 must be fitted according to the depth of cabinet 54. However, support means 75 may be made in a standard length which will fit many lengths of drawers. A cabinet manufacturer may stock track 56 material in long lengths which are cut to fit and only one size of support means 75 to be able to make all of the different drawer lengths desired.

Figure 3:
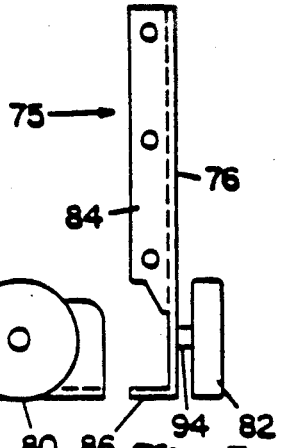
FIG. 3 is a rear end view of the support means from the left side of FIG. 2.

FIG. 3 is a rear end view of support means 75 of FIG. 2. Bracket 76 has vertical flange 84 and horizontal flange 86. Drawer 52 in FIG. 1 rests on horizontal flange 86 with the rear butting against vertical flange 84 and attached thereto by screws. A rear wheel 82 is attached to bracket means 76 by rear wheel axle 94.

Figure 4:
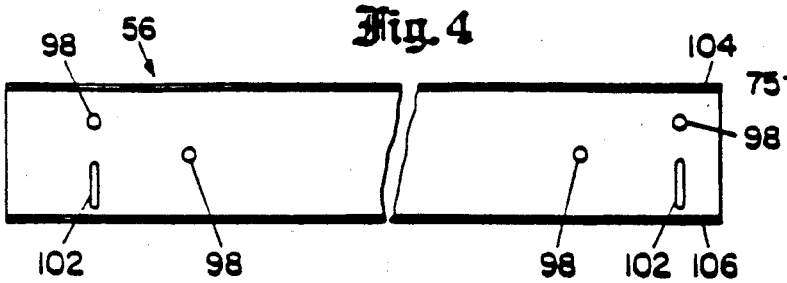
FIG. 4 is a side view of the cabinet track shown in FIG. 1.

FIG. 4 is a side view of cabinet track 56 shown in FIG. 1. Track 56 is attached to the sides of cabinet 54 by screws passing through fixed screw apertures 98. Screw slots 102 may alternately be used to adjust the level of track 56 up and down at either or both ends in relation to cabinet 54 of FIG. 1. Track 56 has upper flange 104 and lower flange 106 for retaining roller wheels such as front wheel 80, rear wheel 82, and alternate rear wheel 88 shown in FIG. 2.

Figure 5:
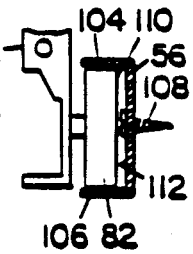
FIG. 5 is an end view of the cabinet track of FIG. 4 with a portion of the support means of FIG. 3 mounted therein.

FIG. 5 is an end view of track 56 illustrated in FIGS. 1 and 4. Track 56 has upper flange 104 and lower flange 106. Track 56 is attached to a cabinet such as cabinet 54 illustrated in FIG. 1 by screws such as screw 108 shown in FIG. 5.

The lower portion of support means 75 of FIG. 3 is shown operating in conjunction with track 56. Rear wheel 82 almost always runs on the inside of upper flange 104. Only when the weight of drawer 52 illustrated in FIG. 1 behind front wheel 80 is greater than the weight of drawer 52 in front of front wheel 80 will rear wheel 82 ride on lower flange 106. Front wheel 80 always rides on the inside surface of lower flange 106. The wheels have point-surface engagement with the tracks.

FIG. 5 illustrates another advantage of the present invention. Precise horizontal alignment between track 56 and roller wheels such as roller wheel 82 is not critical to the operation of drawer slide arrangement 50 except when outer surface 110 of rear wheel 82 presses tightly against inner surface 112 of track 56. Pressure can only occur when tracks 56, as illustrated in FIG. 1, together are narrower in width than the total width of drawer 52 with support means 75 mounted on either rear side. Conversely, if tracks 56 are wider apart than the combined width of drawer 52 and support means 75, rear wheel 82 may slip up out of upper flange 104 and front wheel 80 may slip off of lower flange 106.

Figure 6:
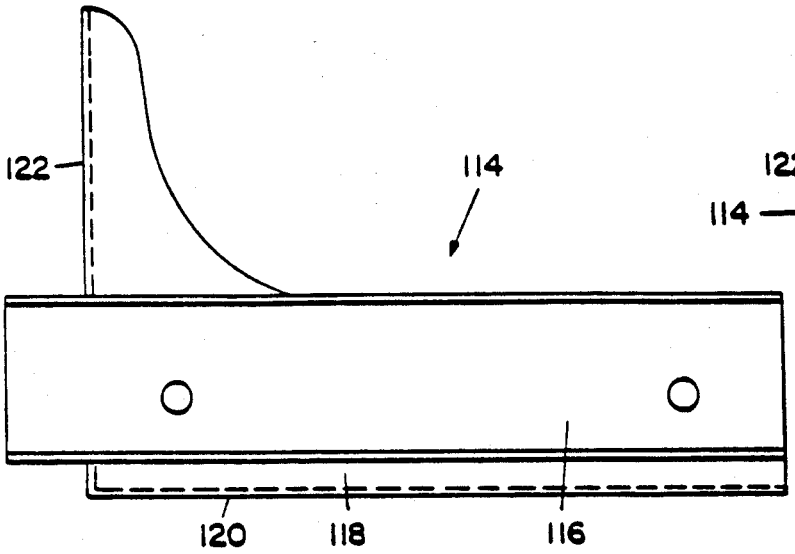
FIG. 6 is a side view of another embodiment of the present invention.

FIG. 6 is a side view of a roller bearing embodiment, generally designated 114, of the present invention. Unlike in FIG. 2, both the track 116 and bracket means 118 are illustrated. Bracket 118 in FIG. 6 functions in the same manner with relation to the rear of drawer 52 shown in FIG. 1 as does bracket 76 illustrated in FIG. 2. Drawer 52 rests on horizontal flange 120 with the rear of drawer 52 abutting vertical flange 122. No extension of bracket 118 past the rear of vertical flange 122 is illustrated as shown in FIG. 2. An extension as shown in FIG. 2 could be added to bracket 118 to increase the length between the front and rear of bracket 118.

Figure 7:
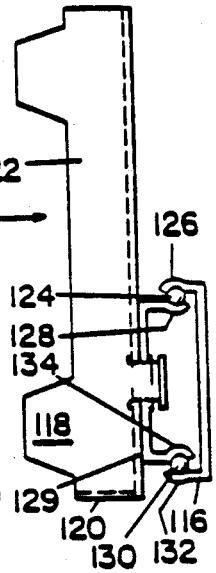
FIG. 7 is a rear end view of the embodiment shown in FIG. 6 from the left side of FIG. 6.

FIG. 7 is a rear end view of roller bearing embodiment 114 illustrated in FIG. 6. Upper ball bearing 124 is located between upper flange 126 of track 116 and upper flange 128 of bracket track 129 coupled to bracket ball bearings extending along the entire length of bracket 118 illustrated in FIG. 6. Similarly, lower ball bearing 130 is located between lower flange 132 of track 116 and lower flange 134 of bracket track 129. Again, lower ball bearing 130 represents a series of lower ball bearings extending along the length of bracket 118. Drawer 52 illustrated in FIG. 1 rests on horizontal flange 120 and butts against vertical flange 122.

Figure 8:
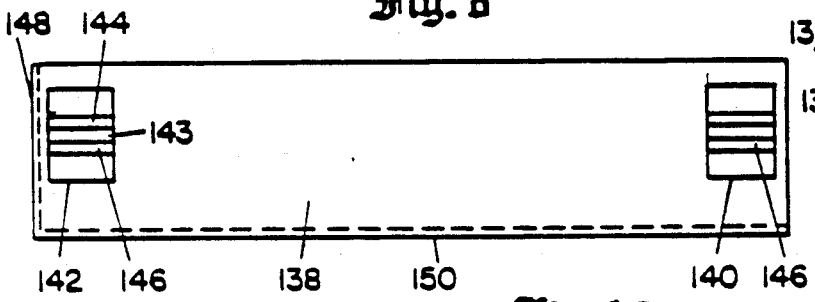
FIG. 8 is a side view of the support means of another embodiment of the present invention.
Figure 9:
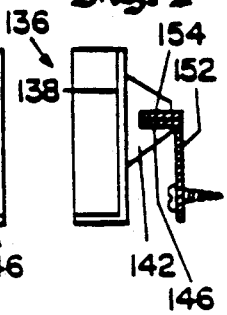
FIG. 9 is a end view of the support means shown in FIG. 8 mounted on a cabinet track.

FIGS. 8 and 9 illustrate another embodiment, generally designated 136, of the present invention having glide blocks as antifriction members. FIG. 8 is a side view of drawer support means 138 having front glide block 140 and rear glide block 142 manufactured of a plastic material having a low coefficient of friction. Each glide block 140 and 142 has glide block slot 143, upper lip 144 and lower lip 146. Drawer 52 shown in FIG. 1 butts against vertical flange 148 and rests on horizontal flange 150.

FIG. 9 is an end view of support means 138 shown in FIG. 8 mounted on cabinet track 152. Cabinet track 152 is the simplest form of the tracks in the present invention and has only a single rail 154 perpendicular to the cabinet. Lower lip 146 of rear glide block 142 usually rides on the underside of rail 154. Front glide block 140, which is not illustrated, always rides with upper lip 144, shown in FIG. 8, bearing on the upper surface of rail 154.

Figure 10:
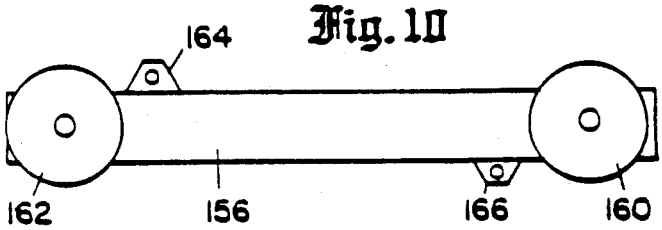
FIG. 10 is a side view of the support means of another embodiment of the present invention.

FIG. 10 is a side view of another embodiment of a support means, generally designated 156, of the present invention. Support means 156 rides in a track identical to track 56 shown in FIGS. 4 and 5. Front wheel 160 is similar to front wheel 80 shown in FIG. 2 and rear wheel 162 is similar to rear wheels 82 and 88. Screws through tabs 164 and 166 are used to secure support means 156 to drawer 52.

Figure 11:
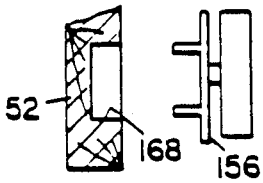
FIG. 11 is an exploded end view of the support means illustrated in FIG. 10 and the receiving slot for the support means in a portion of a drawer.

FIG. 11 is an exploded view of the end of support means 156 illustrated in FIG. 10 and a U-shaped receiving slot 168 in a portion of the side of drawer 52. Support means 156 has a U-shaped Channel that is rapidly and accurately press-fit into drawer 52 with a minimum of skilled labor and time.

Figure 12:
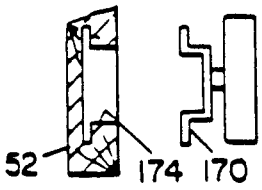
FIG. 12 is an exploded end view of another support means and drawer slot of another embodiment of the present invention similar to the embodiment shown in FIGS. 10 and 11.

FIG. 12 is an exploded end view of another embodiment of a support means, generally designated 170. T-shaped slot 174 is formed in a portion of a side of drawer 52 by the use of a special dado knife. Support means 170 is then inserted into drawer 52 from the rear eliminating the need for most of the fasteners that would normally be required.

Figure 13:
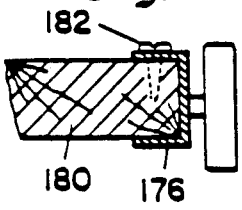
FIG. 13 is an end view of a shelf support means embodiment of the present invention.

FIG. 13 is an end view of another embodiment of a support means, generally designated 176, of the present invention for a shelf. Shelf support means 176 is fitted over the edge of shelf 180 and secured in position by screw 182.

Figure 14:
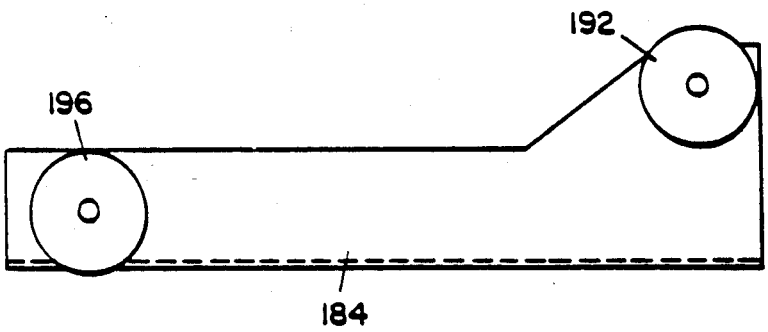
FIG. 14 is a side view of the support means of another embodiment of the present invention.
Figure 15:
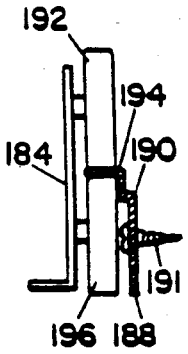
FIG. 15 is an end view of the support means shown in FIG. 14 mounted on a track.

FIG. 14 is a side view of another embodiment of a support means, generally designated 184, of the present invention similar in function to support means 138 illustrated in FIGS. 8 and 9. FIG. 15 is a rear end view of support means 184 on a track 188 similar to track 152 illustrated in FIG. 9. Track 188 is bent at 190 to allow the use of a standard screw 191 to secure 188 to a cabinet such as cabinet 54 illustrated in FIG. 1. Front wheel 192 always rides on the top side of rail 194 of track 188. Rear wheel 196 always rides on the underside of rail 194. Support means 184 illustrates the true cantilevered nature of the present invention. A drawer, such as drawer 52 illustrated in FIG. 1, always rides on support means 184 in the same position whether the drawer is pushed into a cabinet such as cabinet 54 of FIG. 1 or is fully extended out of cabinet 54. Support means 184 minimizes the number of parts required and simplifies the nature of the tracks. Only if the combined weight of the drawer and contents between front wheel 192 and rear wheel 196 exceeds the combined weight of the drawer and contents in front of front wheel 192 will rear wheel 196 not engage the lower side of rail 194.

Figure 16:
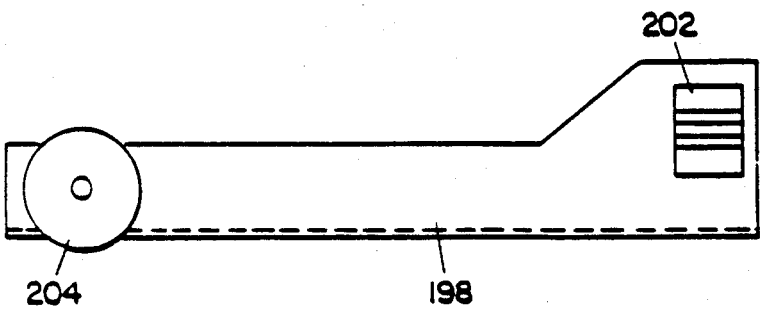
FIG. 16 is a side view of the support means of another embodiment of the present invention.

FIG. 16 is a side view of another embodiment of a support means, generally designated 198, of the present invention similar to support means 184 illustrated in FIGS. 14 and 15. A glide block 202 similar to glide blocks 140 and 142 illustrated in FIGS. 8 and 9 is substituted for front wheel 192 shown in FIG. 14. Rear wheel 204 is similar to rear wheel 196.

Figure 17:
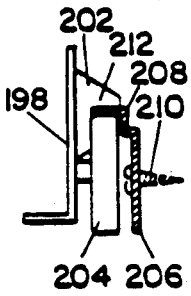
FIG. 17 is an end view of the support means shown in FIG. 16 mounted on a track.

FIG. 17 is an end view of support means 198 mounted on track 206. Track 206, rail 208, and screw 210 are identical to track 188, screw 191 and rail 194 shown in FIG. 15. Rear wheel 204 again usually rides on the underside of rail 208. Glide block 202 always rides with upper lip 212 on the top of rail 208.

Figure 18:
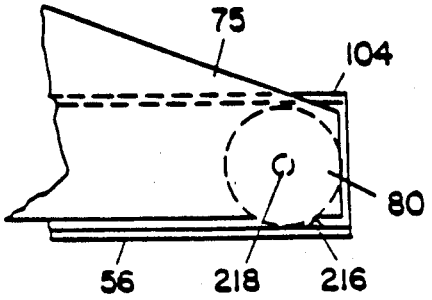
FIG. 18 illustrates a portion of the support means and track of FIG. 1 having a track detent.

FIGS. 18 through 23 illustrate three different stop embodiments for preventing a drawer from being pulled out of a cabinet accidentally. FIG. 18 illustrates the front portion of support means 75 and track 56 shown in FIG. 1. Track detent 216 is simply an indentation in track 56 which presses front wheel 80 against the underside of upper flange 104. Support means 75 may only be removed from track 56 if extra force is used to pull front wheel 80 to the right compressing front wheel 80 between track detent 216 and upper flange 104 until front wheel axle 218 passes to the left of detent 216.

Figure 19:
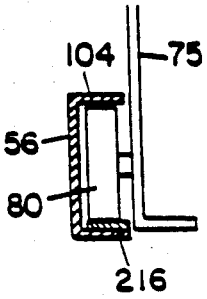
FIG. 19 is a front end view of the detent shown in FIG. 18.

FIG. 19 is an end view of track detent 216 illustrated in FIG. 18.

Figure 20:
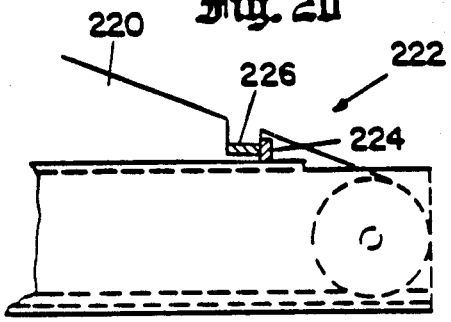
FIG. 20 is a side view of another support means stop.

FIG. 20 is a side view of another drawer stop 222. Stop 222 in FIG. 20 comprises a track tab 224 and a support means tab 226. As support means 220 is pulled to the right, support means tab 226 is stopped by track tab 224.

Figure 21:
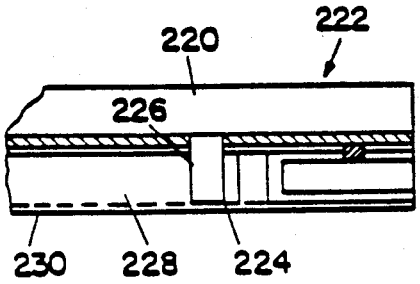
FIG. 21 is a top view of the stop illustrated in FIG. 20.

FIG. 21 is a top view of stop 222 illustrated in FIG. 20. As support means 220 moves to the right, support means tab 226 encounters track tab 224 stopping further motion to the right stop 222 is fabricated by bending down a tongue portion of support means 220 until support means tab 226 is created perpendicular to the plane of the side of support means 220. Similarly, track tab 224 is formed by bending up a portion of the metal of track 228 until track tab 224 is created perpendicular to upper flange 230 of track 228. Initial insertion of a drawer on support means 220 is achieved by raising the drawer so that tab 226 clears tab 224. The drawer is then lowered to its normal horizontal position; and the stop tabs are then operative when the drawer is opened. To remove the drawer, the drawer is again raised so the tabs clear one another.

Figure 22:
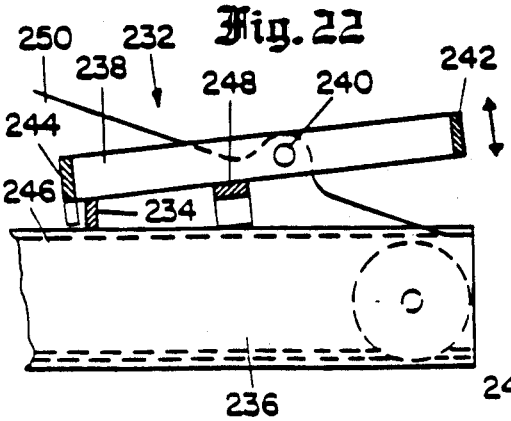
FIG. 22 is a side view of another support means stop.

FIG. 22 is a side view of another stop 232. Track tab 234 is formed in track 236 in the same manner as track tab 224 is formed in track 228 illustrated in FIGS. 20 and 21. The position of track tab 234, however, is further to the left in FIG. 22 in relation to track tab 224 illustrated in FIG. 20 in order to allow operation with stop lever 238. Stop lever 238 rotates about lever axle 240. The distance between handle end 242 and axle 240 is selected to be less than the distance between axle 240 and stop end 244. Stop 244 rests against the upper surface of upper flange 246 due to the heavier weight of lever 238 on the left side of axle 240 in relation to the weight of lever 238 on the right side of axle 240. Lever arm stop 248 formed in the side of support means 250 restricts movements of lever 238 in a counterclockwise direction past lever arm stop 248. Installation or removal of support means 250 is achieved by depressing handle end 242 of stop lever 238 in order to move stop end 244 away from track tab 234.

Figure 23:
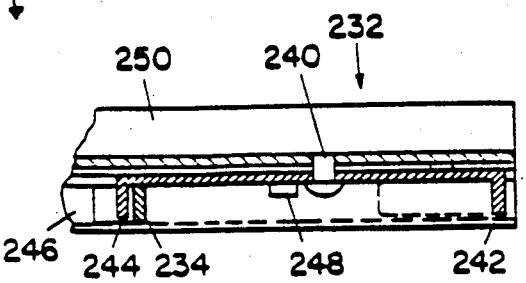
FIG. 23 is a top view of the drawer stop illustrated in FIG. 22.

FIG. 23 is a top view of support means stop 232 illustrated in FIG. 22.

Figure 24:
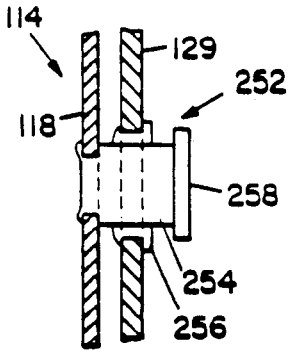
FIG. 24 is an enlarged view of the coupling means of FIG. 7.

FIGS. 24 through 33 illustrate various forms of cabinet to drawer alignment devices and spacers. FIG. 24 is an enlargement of a portion of FIG. 7 showing coupling means 252 positioning bracket track 129 to bracket means 118. FIGS. 6, 7 and 24 illustrate a ball bearing embodiment 114 of the present invention. In order to retain ball bearings 124 and 130 of FIG. 7 between upper flanges 126 and 128 and between lower flanges 132 and 134 respectively, the tolerances required in embodiment 114 are precise and allow little movement of track 116 in relation to bracket track 129. Misalignment of track 116 in relation to bracket track 129 causes binding of ball bearings 124 and 130. Skilled labor and expensive time and effort are required to precisely align track 116 in a cabinet in order to insure that a drawer easily moves in and out. Coupling means 252 moderates the requirement for precise horizontal alignment of bracket 118 in relation to bracket track 129. Bracket track 129 is allowed to move horizontally in relation to bracket 118 along shank portion 254 which is rigidly attached to bracket 118. A slip portion 256 rigidly attached to bracket track 129 is fabricated of a low friction material to allow easy horizontal movement of slip portion 256 along shank portion 254. A shank head 258 restricts movement of slip portion 256 off of shank portion 254.

Figure 25:
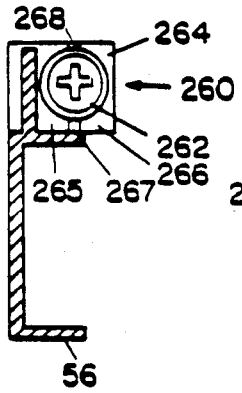
FIG. 25 is a front end view of a drawer alignment means of the present invention.
Figure 26:
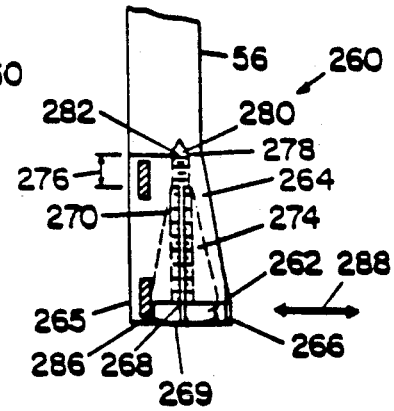
FIG. 26 is a top view of the drawer alignment means of FIG. 25.
Figure 27:
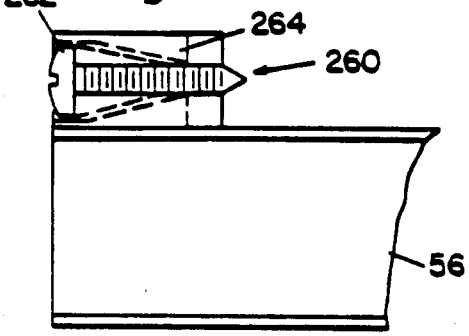
FIG. 27 is a side view of the drawer alingment means of FIGS. 25 and 26.

FIGS. 25, 26 and 27 illustrate an adjustable drawer alignment means 260 for centering a drawer such as drawer 52 in FIG. 1 in cabinet 54. FIG. 25 is a front end view of alignment means 260 fitted on track 56 at the front end next to left piece 64 of FIG. 1. Adjuster screw 262 enters resilient wedge body 264. Wedge body 264 is fabricated of a low friction material and is coupled to track 56. Turning of screw 262 into wedge body 264 forces sides 265 and 266 apart along lower and upper body slots 267 and 268.

FIG. 26 is a top view of alignment means 260 of FIG. 25. Head portion 269 of screw 262 is larger than thread portion 270. Central body aperture 274 has a truncated cone shape with the widest part of the cone having a diameter the same diameter as head portion 269 of screw 262. The narrowest portion of central aperture 274 has a diameter the same size as the shank of the thread portion 270 of screw 262. Central aperture 274 ends a first predetermined length 276 from the inner end 278 of resilient wedge body 264. Wedge body screw aperture 282 has a diameter the same size as the shank of the threaded portion 270 of screw 262. Upper body slot 268 passes from the outer surface 286 to the truncated cone shape of central aperture 274. As adjuster screw 262 is turned into screw aperture 282, head portion 269 forces sides 265 and 266 to spread in the direction of arrows 288 creating a wider resilient wedge body 264. Placement of an adjustment means 260 on both sides of drawer 52 in FIG. 1 allows adjustment of adjuster screws 262 to fill the gaps between the sides of drawer 52 and left side piece 64 and right side piece 66. Horizontal wobble of drawer 52 in cabinet 54 is thereby minimized.

FIG. 27 is a side view of adjustable alignment means 260 of FIGS. 25 and 26.

Figure 29:
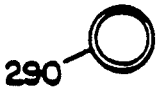
FIG. 29 is a top view of the antifriction button of FIG. 28.
Figure 28:
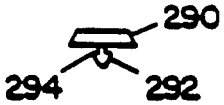
FIG. 28 is an enlarged side view of the side antifriction button of FIG. 2.
Figure 30:
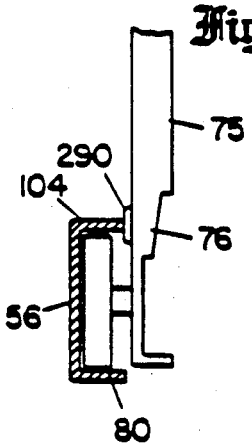
FIG. 30 is an end view of the antifriction button of FIGS. 28 and 29 mounted on a drawer carrier similar to the arrangement shown in FIG. 5.

FIGS. 28, 29 and 30 illustrate an antifriction button placed on the side of support means 75 illustrated in FIG. 2. Button 290 fits between bracket means 76 and upper flange 104 of track 56 as illustrated in FIG. 30. Low friction button 290 keeps bracket 76 and track 56 from rubbing against each other. FIG. 28 is an enlarged side view of button 290. Tip 292 is inserted in an aperture in bracket 76 retaining low friction button 290 in place against tip shoulders 294.

Figure 32:
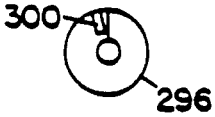
FIG. 32 is a side view of the antifriction button shown in FIG. 31 taken perpendicular to the view of FIG. 31.
Figure 31:
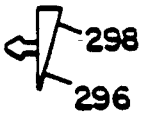
FIG. 31 is an side view of another antifriction button similar to the button shown in FIGS. 28 through 30.
Figure 33:
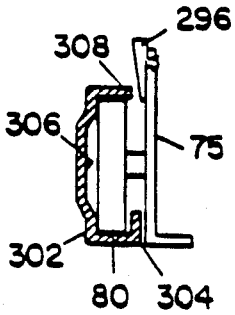
FIG. 33 is an end view of the antifriction button of FIGS. 31 and 32 mounted in a support means similar to the arrangement shown in FIG. 30.

FIGS. 31, 32, and 33 show another variation of an adjustable antifriction button 296. FIG. 31 is a side view of adjustable button 296. Adjustable button 296 is similar to low friction button 290 illustrated in FIG. 28 except for a wedge shape on head 298. FIG. 32 is a top view of adjustable button 296 of FIG. 31 illustrating button slot 300 which may be used to rotate adjustable button 296 once it is in position on the side of a bracket means such as bracket 76 illustrated in FIG. 2. FIG. 33 is a front end view of adjustable button 296 mounted in support means 75. Support means 75 is shown operating in a track 302 having more complicated contours than track 56 illustrated in FIG. 30. Inner flange lip 304 is designed to retain front wheel 80 in track 302 by elimination of the possibility of front wheel 80 slipping out of track 302 to the right in FIG. 33. Indented portion 306 allows clearance for the head of an ordinary screw between indented portion 306 and front wheel 80 in the same manner as screw 210 illustrated in FIG. 17. Rotation of adjustable button 296 by use of slot 300 shown in FIG. 32 allows turning of the wedge down until adjustable spacer 296 fills the gap between support means 75 and upper flange 308. Side to side wobble of a drawer such as drawer 52 is thereby minimized when in an extended position from cabinet 54 as shown in FIG. 1.

Figure 34:
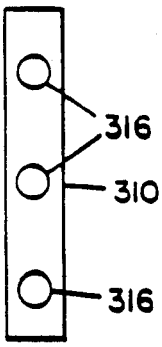
FIG. 34 is a front view of a stapling strip of the present invention.
Figure 35:
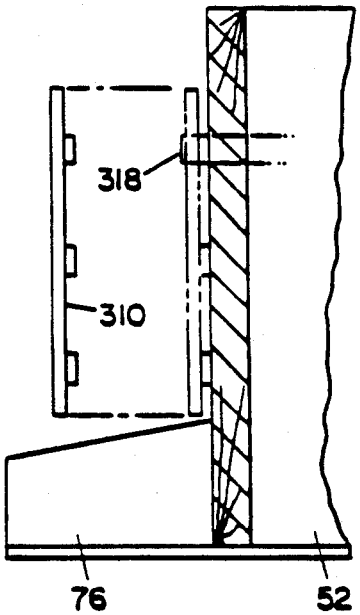
FIG. 35 is a side view of the stapling strip of FIG. 34 utilized to assemble the drawer carrier of the present invention to a drawer.
Figure 36:
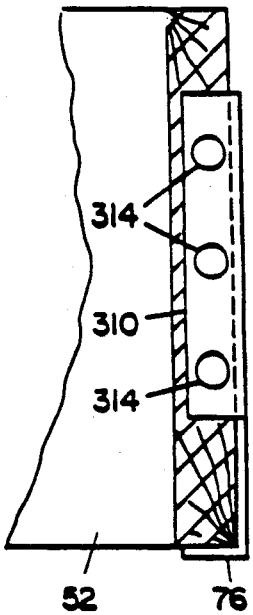
FIG. 36 is a rear end view of the arrangement shown in FIG. 35.

FIGS. 34, 35 and 36 illustrate the use of stapling strip 310 to couple bracket 76 to drawer 52. Bracket 76 has a plurality of bracket attachment apertures 314. FIG. 34 is a front view of stapling strip 310 fabricated of a plastic material which is penetrable by staples and has attachment aperture fillers 316 which are inserted into attachment apertures 314. FIG. 35 is an exploded side view of stapling strip 310 being inserted onto bracket 76 and a staple 318 inserted through upper attachment aperture filler 316. In this manner, bracket 76 is rapidly attached to drawer 52 by the use of staples 318 in a fraction of the time that would be required to insert individual screws through attachment apertures 314. FIG. 36 is a rear end view of the arrangement shown in FIG. 35.

Figure 37:
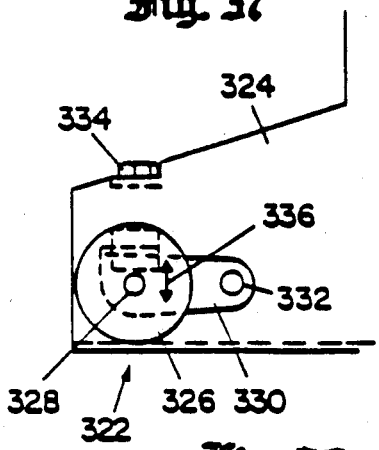
FIG. 37 is a side view of another embodiment of a roller mounting means.

FIG. 37 is a side view of another roller wheel mounting means 322. Support means 324 is similar to support means 75 illustrated in FIG. 2. Roller mounting means 322 may be mounted on either the front or back of a support means such as support means 75. Roller wheel 326 is mounted on wheel axle 328 which is in turn coupled to roller wheel lever 330. Roller wheel lever 330 is mounted and rotates about roller wheel lever axle 332. Roller wheel lever 330 is adjustably and rigidly held in a predetermined position by roller wheel lever positioner screw 334. The vertical position of roller wheel 326 in relation to support means 324 is thereby precisely adjustable as desired in any vertical placement in accordance with arrow 336.

Figure 38:
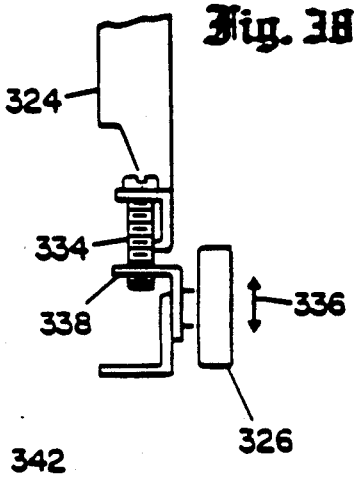
FIG. 38 is an end view of the embodiment shown in FIG. 37.

FIG. 38 is an end view of roller wheel mounting means 322 of FIG. 37 illustrating the operation of screw 334. Turning of screw 334 down causes flange 338 to rise on screw 334. Precise adjustment of wheel 326 as indicated by arrow 336 is thereby possible in relation to support means 324.

Figure 39:
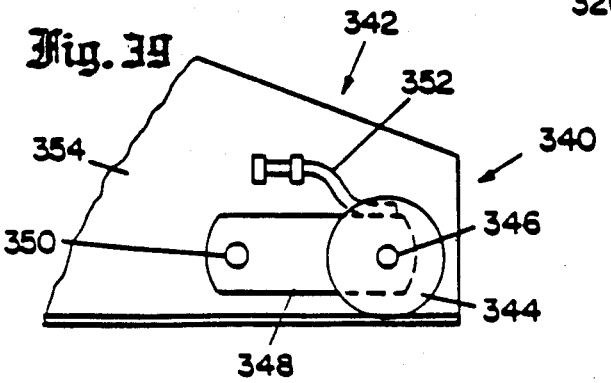
FIG. 39 is a side view of another roller wheel mounting means.

FIG. 39 is a side view of another roller wheel mounting means 340 similar to the roller mounting means 322 of FIGS. 37 and 38. Embodiment 342 has a roller wheel 344, wheel axle 346, roller wheel lever 348 and roller wheel lever axle 350 similar to the corresponding parts of roller wheel mounting means 322 shown in FIGS. 37 and 38. A roller wheel lever spring 354 biases roller wheel lever 348 away from support means 352 so that when a drawer is overloaded to exceed the capacity of roller wheel lever spring 352, the front of drawer 52 as illustrated in FIG. 1 drops down onto bottom front piece 62 to preserve the integrity of support means 354.

Figure 40:
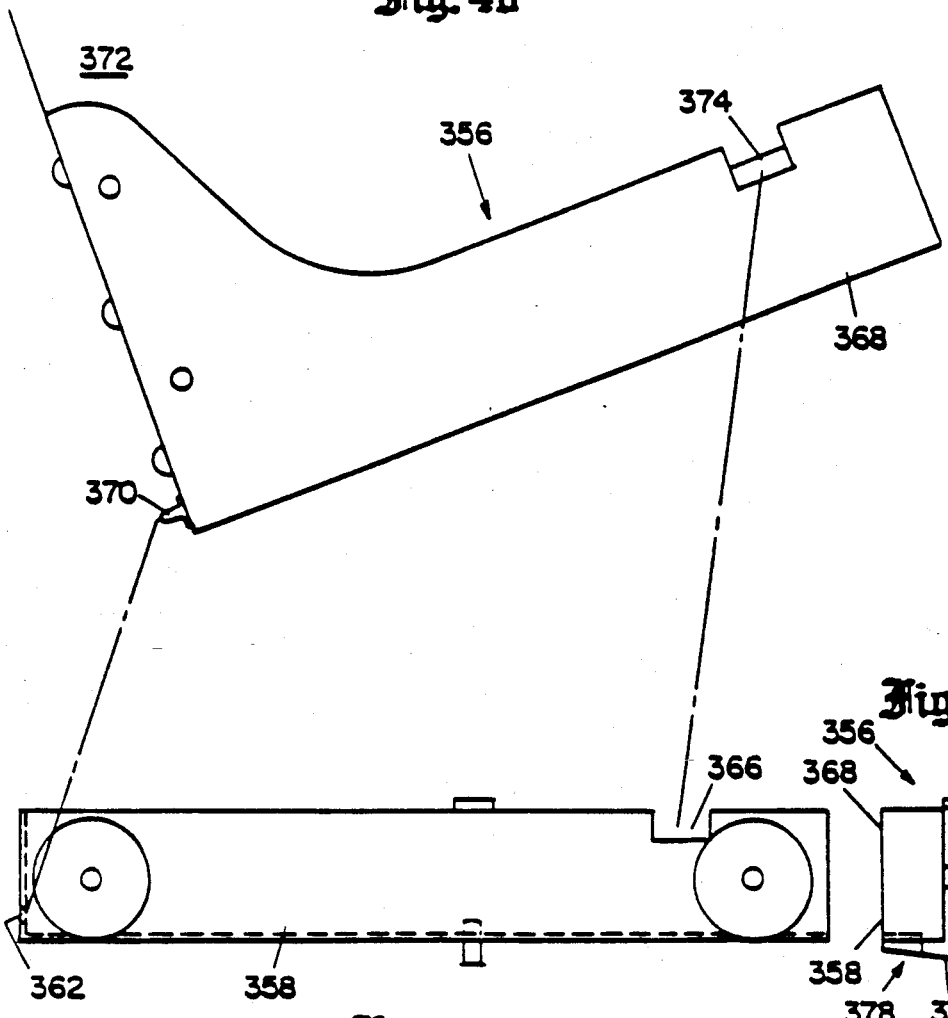
FIG. 40 is a side view of another embodiment of the present invention.

FIG. 40 is a side view of yet another embodiment, generally designated 356, of the present invention which allows removal of drawer 372 without removal of support means 358. Support means 358 has drawer pin aperture 362, and drawer tab slot 366. Drawer bracket 368 has a drawer pin 370 coupled to the rear of drawer 372 and a drawer tab 374. Drawer 372 is inserted in support means 358 and retained therein by inserting drawer pin 370 in drawer pin aperture 362 and lowering the front of drawer 372 so that drawer tab 374 is retained in drawer tab slot 366. Removal of drawer 372 is equally easy by the lifting of the front of drawer 372 so that drawer tab 374 leaves drawer tab slot 366 and drawer 372 may be pulled forward to pull drawer pin 370 from drawer pin aperture 362.

Figure 41:
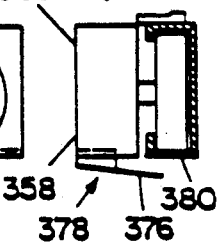
FIG. 41 is an end view of the support means shown in FIG. 40 mounted on a track.

FIG. 41 is an end view of embodiment 356 illustrated in FIG. 40. Bracket 368 is in position pushing down on holding spring 376 of holding means 378 to keep holding spring 376 away from track 380. Holding means 378 keeps support means 358 from moving when drawer 372 in FIG. 40 is removed.

Figure 42:
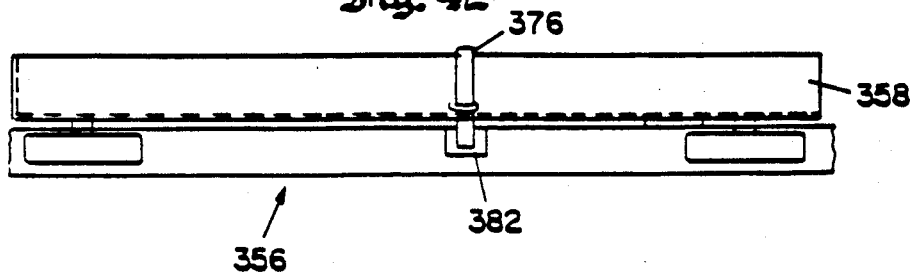
FIG. 42 is a top view of the support means shown in FIGS. 40 and 41.

FIG. 42 is a top view of embodiment 356 of FIGS. 40 and 41 illustrating the location of holding spring 376 in relationship to track slot 382. Drawer 372 has been removed allowing holding spring 376 to enter track slot 382. Movement of support means 358 to the left or right is thereby restricted to the width of track slot 382. When drawer 372 is reinserted in support means 358, the weight of drawer 372 pushes down on holding spring 376 causing holding spring 376 to lift out of track slot 382. Support means 358 is then free to move in relation to track 380.

Having now reviewed the above description and the drawings, those skilled in the art will realize that a wide variety of embodiments may be employed in producing equipment in accordance with the present invention. In many instances, such embodiments may not even resemble that depicted here and may be used for applications other than that shown and described. Nevertheless, such embodiments will employ the spirit and scope of the invention as set forth in the following claims.

I claim:

1. A simplified drawer guide system in combination with a drawer and a cabinet comprising a pair of metal tracks, respectively mounted rigidly to the cabinet at opposite sides of the drawer and extending forwardly and rearwardly, the drawer having upright front, rear and left and right side walls defining a storage space, left and right metal brackets attached to the outermost surfaces of the left and right side walls of the drawer, each bracket having a plate carrying rollers independently of said drawer side walls, with the rollers spaced in cantilevered and sidewardly offset relation to the plate and to the drawer, the rollers associated with each bracket mounted onto one of the tracks for supporting the drawer rearward extent for forward and rearward drawer travel relative to the cabinet, the rollers, brackets and tracks being everywhere confined rearwardly of an upright plane defined by the front of the cabinet when the bulk of the drawer is pulled forwardly to project at the front side of said plane, each bracket including a first and vertically upright flange integral with an upwardly projecting portion of the plate and extending at right angles thereto and engaging the rear end of the drawer and attached thereto, said first flange extending above the levels of the rollers, there being only two rollers carried by each plate to extend proximate opposite ends respectively, of the plate, the rollers spaced forwardly and rearwardly, the track being channel shaped and the rollers received within the track channel, and including adjustable means carried by the tracks to adjustably move toward opposite outer sides of the drawer, for engagement with said sides to limit and reduce drawer side-to-side wobble during drawer in and out movement.

and wherein said brackets and rollers and tracks are entirely confined adjacent about the rearwardmost one-third of the drawer when the drawer is pulled fully forwardly to project at the front side of the cabinet.

2. The drawer guide system of claim 1 wherein the plate has un upper edge which extends forwardly and downwardly from a rearward locus near the uppermost extent of the first flange to a forward locus near the forward roller.

3. The drawer guide system of claim 2 wherein each bracket includes a second and horizontal flange integral with the plate and extending at right angles thereto and normal to the plane of the plate, and engaging a corresponding drawer corner surface and attached thereto, the rollers carried by each plate freely and openly projecting sidewardly from the same side of the plate, and opposite to the direction of flange projection relative to the plate.

4. The drawer guide system of claim 1 wherein said adjustable means includes adjustable screws and means including wedge structure responsive to screw rotation to move toward said drawer sides.

5. A simplified drawer guide system in combination with a drawer and a cabinet comprising a pair of metal tracks, respectively mounted rigidly to the cabinet at opposite sides of the drawer and extending forwardly and rearwardly, the drawer having upright front, rear and left and right side walls defining a storage space, left and right metal brackets attached to the outermost surfaces of the left and right side walls of the drawer, each bracket having a plate carrying anti-friction means independently of said drawer side walls, with the anti-friction means spaced in cantilevered and sidewardly offset relation to the plate and to the drawer, the anti-friction means associated with each bracket mounted onto one of the tracks for supporting the drawer rearward extent for forward and rearward drawer travel relative to the cabinet, the anti-friction means, brackets and tracks being everywhere confined rearwardly of an upright plane defined by the front of the cabinet when the bulk of the drawer is pulled forwardly to project at the front side of said plane, each bracket including a first and vertically upright flange integral with an upwardly projecting portion of the plate and extending at right angles thereto and engaging the rear end of the drawer and attached thereto, said first flange extending above the levels of the anti-friction means, there being only two anti-friction means carried by each plate to extend proximate opposite ends respectively, of the plate, the anti-friction means spaced forwardly and rearwardly, the track being channel shaped and receiving the two anti-friction means within said track channel, the anti-friction means having point-surface contact with the track, and including adjustable means carried by the tracks to adjustably move relatively toward opposite outer sides of the drawer, for engagement with said sides to limit and reduce drawer side-to-side wobble during drawer in and out movement, and wherein said brackets, anti-friction means and tracks are entirely confined adjacent about the rearwardmost one-third of the drawer when the drawer is pulled fully forwardly to project at the front side of the cabinet.

* * * * *